United States Patent [19]

Moberg

[11] 4,063,434

[45] Dec. 20, 1977

[54] PLUNGER-OPERATED LOCK

[75] Inventor: Sigurd M. Moberg, Etlan, Va.

[73] Assignee: E. J. Brooks Company, Newark, N.J.

[21] Appl. No.: 784,111

[22] Filed: Apr. 4, 1977

[51] Int. Cl.[2] ..... E05B 67/36

[52] U.S. Cl. ..... 70/34; 70/386

[58] Field of Search ..... 70/14, 25, 32–34, 70/386; 292/252; 339/91 B; 24/211 N

[56] References Cited

U.S. PATENT DOCUMENTS

| | | | |
|---|---|---|---|
| 1,923,025 | 8/1933 | Morse | 70/34 |
| 3,714,802 | 2/1973 | Morse | 70/34 |
| 3,835,674 | 9/1974 | Hoyt | 70/34 |
| 4,015,456 | 4/1977 | Moberg | 70/34 |

*Primary Examiner*—Robert L. Wolfe

*Attorney, Agent, or Firm*—Robert E. Ross

[57] ABSTRACT

A lock of the type having an internal plunger with a stem for being gripped by a tool to pull the stem axially to release locking means, the stem being biased to the locking position by a coil spring so dimensioned that when the spring is fully compressed with the coils touching each other, the pin just reaches the unlocking position. Hence if an attempt is made to open the lock by inserting a bent wire or the like into a spring coil and pulling to compress the spring, the pin will not be able to move to the unlocking position.

4 Claims, 3 Drawing Figures

PLUNGER-OPERATED LOCK

BACKGROUND OF THE INVENTION

In the electric meter box art it is becoming increasingly necessary to provide positive means for locking closed the cover of the meter box, to prevent unauthorized persons from gaining access to the terminals inside the box. Locking is often accomplished by the use of a so-called barrel lock or plunger lock, such as is shown in my U.S. Pat. No. 3,186,196 issued June 1, 1965.

This lock comprises a housing and a pair of balls which are moved outwardly into the locking position by an internal axially movable plunger. The plunger is spring biased to the locking position, and is moved to the unlocking position by the insertion of an expandable tool into the end of a hollow stem of the plunger. The tool frictionally grips the internal walls of the stem so that tension can be applied to the plunger to pull it, against the force of the spring, to the unlocking position.

However, it has been found that it is possible to jam an article, such as a wire with a suitably bent end, into the stem cavity, and with sufficient perseverance, to obtain sufficient frictional engagement with the internal stem wall to pull the plunger to the unlocking position.

To prevent the possibility of defeating a lock of this type, I have disclosed and claimed in U.S. patent application Ser. 700,078, filed 06/28/76, a lock of this type having a separate tool-engaging member in a recess on the rear end of the plunger, said member having a pin protruding through a cover plate on the rear end of the recess. The separate tool-engaging member is spring-biased against the bottom of a recess in the plunger. When an axial pulling force is applied to the pin, it pulls the plunger rearwardly in the usual manner to release the locking means. However, when a pushing force is applied to the pin, it is forced into the recess through the opening in the cover plate to become inaccessible, and preventing an unauthorized tool from gripping engagement therewith.

However, it has been found possible, in some cases, to open a lock of the type described in the above-identified application by inserting a bent end of a wire into one of the rearmost coils of the spring that biases the pin to the locked position, and pulling to compress the spring so that the pin can move to the unlocked position.

SUMMARY OF THE INVENTION

In accordance with this invention, I provide further means to prevent defeating locks of this type, which in some instances can be done by the insertion of the bent end of a wire into the coils of the spring that biases the pin assembly to the locking position and pulling to compress the spring, thereby allowing the pin assembly to move to the unlocking position. To prevent this, I dimension the components of the lock so that just as the pin, in being retracted, reaches the unlocking position, the coil spring, that biases the pin to the locking position, becomes fully compressed. In other words, the spring must be fully compressed with the coils touching each other to allow the pin to reach the unlocking position. Hence if an attempt is made to compress the spring by pulling it with the bent end of a wire inserted between a pair of coils remote from the open end of the lock, the spring cannot be fully compressed, even if the wire is inserted between the last two coils, because of the additional length of the compressed spring caused by the presence of the wire between the coils prevents the pin from reaching the unlocking position.

DESCRIPTION OF THE ILLUSTRATED EMBODIMENT

Figure 1:
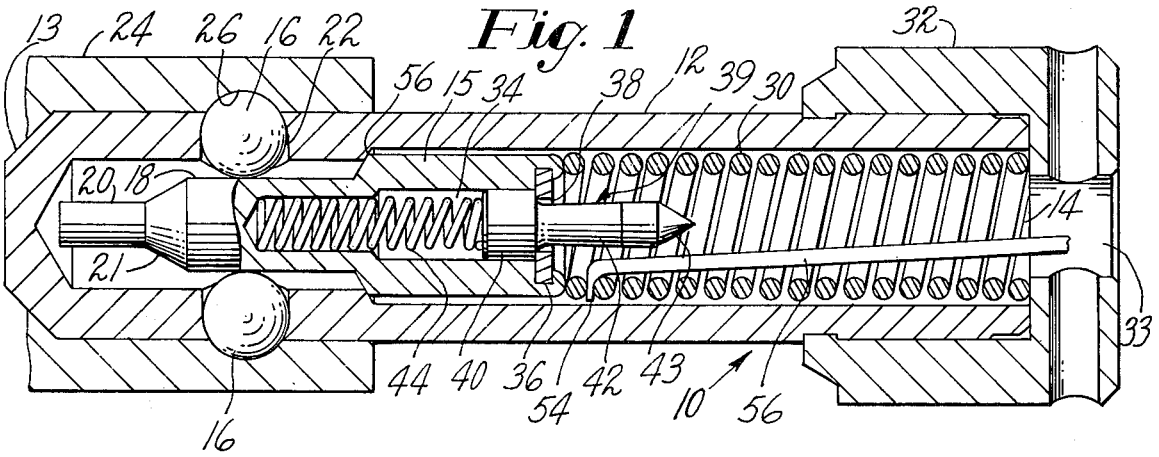
FIG. 1 is a view in side elevation of a lock assembly embodying the features of the invention, in which the components are in the locked condition.

Referring to the drawing, there is illustrated a plunger type lock 10 which comprises a housing 12 having a closed end 13, an open end 14, and a plunger 15 movable axially in the housing to move a pair of locking balls 16 between an unlocking and a locking position.

The forward end of the plunger 14 is provided with a forwardly projecting cylindrical ball positioning member having a rear portion 18 and a smaller forward portion 20 connected by a cam surface 21. The balls 16 are retained in suitable apertures 22 in the housing wall. The parts are so dimensioned that when the plunger is in the forward or locking position (see FIG. 1) the portion 18 of the plunger is disposed between the balls forcing them outwardly so that they project from the outer surface of the housing, and when the plunger is retracted, the balls can ride down the cam surface 21 to rest against the smaller portion 20, so that the outer periphery of the balls is at or inside the outer surface of the housing 12.

The lock is illustrated as being used with a separate locking cap 24, which has an internal groove 26 in which the balls 16 seat to retain the cap locked onto the end of the lock 10. This assembly may be used to lock the operating lever of a valve (not shown) in a desired position. However, the lock 10 may also be used to lock the cover of a meter box in the closed position, or to lock a meter retaining ring. In such application, instead of locking in a separate cap 24, the lock may extend into an aperture in a suitably positioned bracket. Such an assembly is shown in U.S. Pat. No. 3,867,822.

The plunger 15 is biased to the forward position (as in FIG. 1) by a spring 30 disposed between the rear end of the plunger and a spring retaining cap 32 press-fitted or otherwise retained over the open end 14 of the housing 12. The cap has a central opening 33 for receiving a lock operating tool, as will be described hereinafter.

To provide means for retracting the plunger 15 to release the lock, a cavity 34 is provided in the rear end of the plunger, with a cover plate 36 retained over the cavity entrance. The cover plate 36 has a central aperture 38 in which is assembled a pin 39 having an enlarged head 40 disposed in the cavity 34 and a tool engaging portion 42 extending through the cover plate aperture 38 and protruding therefrom toward the open end of the housing in alignment with the aperture 33 in the bushing. The portion 42 has a conical end 43 for a purpose to appear hereinafter.

The pin 39 is biased to the extended position by a spring 44 disposed between the cavity bottom and the enlarged head 40.

The lock may be released by a suitable tool 46, which, in the illustrated embodiment, comprises an elongated hollow housing 48 retained within which is a pair of jaws 50 which normally protrude from the housing and are spread apart far enough to receive the protruding portion 42 of the pin therebetween. The outer end portion of the jaws 50 have outwardly inclined surfaces 52 and means (not shown) is provided to cause the jaws 50 to be retracted into the housing, whereby the surfaces 52 cam the jaws together to cause them to grip the pin portion 42. Retracting motion of the tool will thereafter pull the pin and plunger rearwardly toward the open end of the housing, to compress the spring 30, to move the smaller forward end 20 plunger into alignment with the balls 16 so that they move inwardly to the unlocking position.

Figure 2:
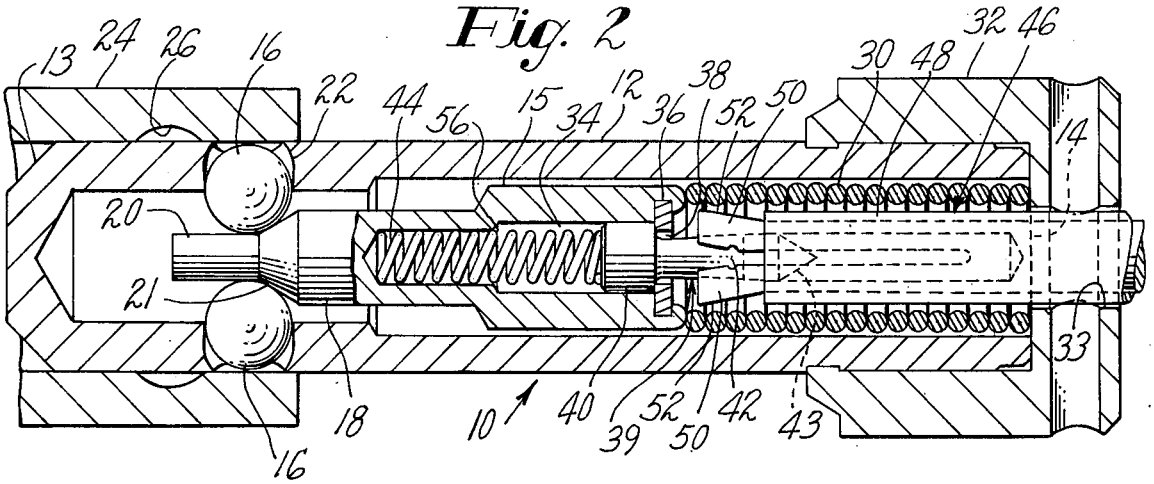
FIG. 2 is a view of the lock assembly of FIG. 1 in which the components have been pulled to the unlocked condition by a suitable tool.

As illustrated in FIG. 2, it is seen that the spring 30 must be completely compressed with the coils touching each other to allow the plunger 15 to move rearwardly far enough to allow the balls 16 to retract to the unlocking position.

Tools of a type suitable for grasping and pulling a pin of the type described are well known in the art and do not form part of the present invention. A form of tool for this purpose is illustrated in U.S. Pat. No. 3,446,045 issued May 27, 1969.

Attempts to open the illustrated lock may be made by unauthorized persons with various types of tools. Previous locks with protruding pins are occasionally successfully opened by driving a piece of tubing of suitable internal diameter over the end of the pin, to frictionally grip the pin with sufficient strength to allow it to pull the plunger against the force of the biasing spring. However, an attempt to drive a tubing over the protruding portion of the pin causes the pin to retract through the cover plate 36. The dimensions of the components are such that when the enlarged head 40 of the pin bottoms against a shoulder 56 in the cavity 34, substantially only the conical end 43 protrudes from the cover plate, which is impossible for the tubing to grip.

The conical end 43, in addition to facilitating the positioning of the tool jaws 50 over the pin, also tends to deflect other types of inserted implements, such as thin blades or wires, to prevent them from being wedged between the pin and the cover plate.

As mentioned hereinbefore, in some cases it has been found possible to open a lock of this type by inserting the bent end 58 of a wire 60 between coils of the spring 30 and pulling to compress the spring, allowing the pin 15 to move (by gravity or by jarring the lock endwise) into the un-locking position.

Figure 3:
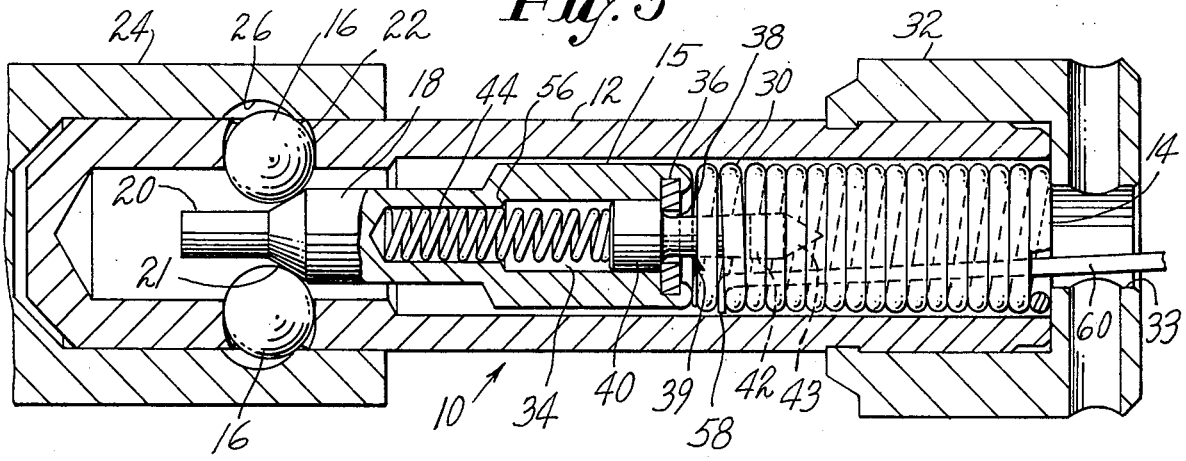
FIG. 3 is a view of the lock assembly of FIG. 1 in which the components have been pulled toward the unlocking position by a wire having a bent end inserted into the spring coils.

However, the components of the illustrated lock are so dimensioned that it is impossible to open the lock in this manner, since the components are so dimensioned that for the pin 15 to move far enough rearwardly (to the right in FIG. 3) to allow the balls 16 to ride down the cam surface and reach the surface of the projecting portion 20 of the pin, so that the balls retreat to the unlocking position, the spring 30 must be completely compressed, or "bottomed" with the coils touching each other.

Hence when the bent end 58 of the wire is disposed between a pair of spring coils, in an attempt to open the lock without the proper tool, the spring cannot compress fully, but when compressed as much as possible, is longer by at least the diameter of the wire. Since, to have the strength necessary to pull the spring into compression, the wire must have appreciable thickness, for example 0.040 inches, the spring will be at least 0.040 inches longer when compressed as much as possible by the wire. This extra length is sufficient to prevent the balls 16 from reaching the smaller portion 20 of the plunger, and instead remain part way up the cam surface 21. Therefore, the outer surface remains protruding from the outer surface of the housing 12, preventing removal of the locking cap 24.

Since certain obvious changes may be made in the illustrated embodiment of the invention without departing from the scope thereof, it is intended that all matter contained herein be interpreted in an illustrative and not a limiting sense.

I claim:

1. A lock of the plunger-operated type, having a housing with an opening at one end, a lock-operating plunger axially movable in the housing between a locking and an unlocking position and biased forwardly away from the opening by a coil spring, and a tool-engagable member mounted on the plunger, said components being so arranged that pulling on the tool-engagable member compresses the coil spring and moves the plunger toward the unlocking position, the components being so dimensioned that complete compression of the coil spring is required to permit the plunger to reach the unlocking position.

2. A lock as set out in claim 1 having locking means comprising radially movable members which protrude substantially from the outer surface of the housing when in the locking position and are substantially flush with the outer surface of the housing when in the unlocking position, said members being maintained in the protruding position when the plunger is in the forward position by a first portion of the plunger and being movable down a cam surface on the plunger to rest against a second smaller plunger portion when the plunger is pulled rearwardly to compress the coil spring, said cam surface and said smaller portion of the plunger being so positioned on the plunger that the locking member cannot move down the cam surface to reach the unlocking position until the coil spring is completely compressed with adjacent coils touching each other.

3. A lock as set out in claim 1 in which said tool-engagable member is normally spring-biased to protrude from the plunger toward the housing opening for grasping by a lock-operating tool, and is movable into the plunger into an inaccessible position on the application of a forward force thereto.

4. A plunger-operated lock of the type having a housing open at one end, a plunger in the housing and axially movable therein between a forward position in which the plunger retains locking elements in a locking position and a rear position in which the locking elements can move to a non-locking position, said plunger being biased to the locking position by a coil spring, said spring being positioned to be compressed when the plunger moves toward the unlocking position, the components being so dimensioned that the plunger reaches the position at which the locking elements can move to the unlocking position only when the coil spring is fully compressed with adjacent coils touching each other.

* * * * *